US008393473B2

(12) United States Patent
Gustafsson

(10) Patent No.: US 8,393,473 B2
(45) Date of Patent: Mar. 12, 2013

(54) MIXTURE OF COLLECTORS FOR FLOTATION OF CLAY MINERALS FROM POTASH ORES

(75) Inventor: Jan Olof Gustafsson, Kungälv (SE)

(73) Assignee: Akzo Nobel N.V., Arnhem (NL)

( * ) Notice: Subject to any disclaimer, the term of this patent is extended or adjusted under 35 U.S.C. 154(b) by 116 days.

(21) Appl. No.: 13/131,314

(22) PCT Filed: Nov. 26, 2008

(86) PCT No.: PCT/EP2008/066248

§ 371 (c)(1),
(2), (4) Date: May 26, 2011

(87) PCT Pub. No.: WO2010/060477

PCT Pub. Date: Jun. 3, 2010

(65) Prior Publication Data

US 2011/0226674 A1 Sep. 22, 2011

(51) Int. Cl.
*B03D 1/01* (2006.01)
*B03D 1/02* (2006.01)

(52) U.S. Cl. ..... 209/166; 252/61

(58) Field of Classification Search ..... 209/166; 252/61

See application file for complete search history.

(56) References Cited

U.S. PATENT DOCUMENTS

| | | | | |
|---|---|---|---|---|
| 3,154,489 | A | 10/1964 | Du Brow et al. | |
| 3,428,683 | A | 2/1969 | Swenson et al. | |
| 3,805,951 | A | 4/1974 | Brogoitti et al. | |
| 4,192,737 | A | 3/1980 | Thompson et al. | |
| 4,198,288 | A * | 4/1980 | Levine et al. | 209/5 |
| 4,608,154 | A * | 8/1986 | Chan et al. | 209/166 |

FOREIGN PATENT DOCUMENTS

| | | | |
|---|---|---|---|
| GB | 953550 | | 3/1964 |
| GB | 2 125 058 | A | 2/1984 |
| RU | 2 237 521 | | 10/2004 |
| SU | 1304893 | A1 | 4/1987 |
| WO | WO 2008/152029 | A9 | 12/2008 |

OTHER PUBLICATIONS

International Search Report for PCT Application No. PCT/EP2008/066248; Completion date Aug. 25, 2009.
English lanuage machine translation of Russian Patent Publication No. RU 2278739.
Thomson Reuters Abstract No. 2004-792554 for Russian Patent Publication No. 2237521C1.
Thomson Reuters Abstract No. 1987-340564 for U.S.S.R. Patent Publication No. 1304893A1.

* cited by examiner

*Primary Examiner* — Thomas M Lithgow
(74) *Attorney, Agent, or Firm* — Ralph J. Mancini; Sugiarto Hadikusumo

(57) ABSTRACT

The invention relates to a flotation process for removal of slimes from potash ores which includes a step in said process wherein a collector is used which is a mixture of ethoxylated fatty amines having the formulae (I) wherein R1 and R2 are, independently, a hydrocarbyl group having 1-22 C-atoms, and n is on average above 15 and less than 100, and (II) wherein R3 is a hydrocarbyl group having 8-22 carbon atoms; z is a number 1-3; X, Y and Y' are, independently, an alkyl group with 1-4 carbon atoms or the group $-(EO)_sH$, wherein EO is an ethyleneoxy unit and s is on average 5-50, and the sum of all s is on average 15 or more, and less than 100; provided that at least one of X, Y and Y' is a group $-(EO)_sH$; and where the molar ratio of I to II is 1:5 to 5:1. The invention also relates to said mixtures of collectors where the molar ratio of I to II is 1:5 to 5:1. The invention further relates to a process wherein the above process step of flotation of slime is followed by a step of flotation of KCl using a different type of collector.

(I)

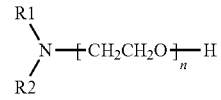

(II)

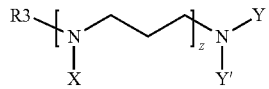

12 Claims, No Drawings

MIXTURE OF COLLECTORS FOR FLOTATION OF CLAY MINERALS FROM POTASH ORES

The present case is based on International patent application No. PCT/EP2008/066248 filed Nov. 26, 2008.

The present invention relates to a process to remove clay slimes from potash ores by flotation of at least part of said slimes, using a mixture of specific ethoxylated secondary fatty amines and fatty polypropylene amines as collectors.

Potash ore froth flotation is a conventional process for recovering sylvite (KCl) from ore pulps. Examples of potash ores are sylvinite, carnallite, langbeinite, and kainite, and of these sylvinite is easiest to process.

Common gangue minerals in addition to halite (NaCl) are different types of water-insoluble fine-grained minerals, such as clay minerals, anhydrite, iron oxides, etc., often called slime. The siliceous gangue (clay) consists of very fine particles and represents a large surface area, which adversely affects the recovery of sylvite (KCl) in the potash ore froth flotation process. The collector used during the potash flotation typically adsorbs to the clay, which results in high collector consumption and poor metallurgical results. The clay also interferes with other sylvite beneficiation processes such as dissolution procedures.

Several technical developments have addressed the problems arising from the presence of slime. Mechanical methods such as use of hydro cyclones, centrifuges, hydro separators, etc. are unselective and result in losses of fine particle sylvite. Several patents describe a process where clay-containing sylvinite ores are deslimed by a selective flocculation of slime (clay) followed by froth flotation of the slime. Polyacrylamides are mainly used as flocculants, and several compounds are suggested as collectors. Examples of collectors disclosed in the literature are oxyethylated primary amines (U.S. Pat. No. 3,805,951 and RU 2278739), mixtures of non-ionic and anionic collectors (U.S. Pat. No. 4,192,737), oxyethylated fatty acids (SU1304893), and oxyethylated alkyl phenol (RU2237521).

U.S. Pat. No. 3,805,951 describes a process for desliming sylvinite ores by selective flocculation, followed by froth flotation of the slime. The process includes treatment of the ore pulp with a high molecular weight acrylamide polymer to flocculate the slime and then with a cationic collector that is for example a condensation product of 1 to 10 moles of ethylene oxide with one mole of a C12-C18 primary or secondary aliphatic amine.

RU 2278739 describes a method for enrichment of potassium ores which comprises disintegrating the ore, removing water-insoluble clay-carbonate impurities by formation of a flotation slurry, followed by flotation of potassium chloride. The compounds used for flotation slurry formation are oxyethylated primary amines with 15-50 ethoxy groups per mole of amine.

However, there is still a need for more effective collecting agents for desliming potash ores which do not have a negative effect on the recovery of potassium.

Now it has surprisingly been found that a mixture of compounds having the formulae

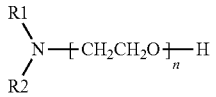

(I)

wherein R1 and R2 are, independently, a hydrocarbyl group having 1-22 C-atoms, and n is on average above 15, preferably above 20, and less than 100, preferably less than 80, more preferably less than 60, even more preferably less than 50, still more preferably less than 40, and most preferably less than 35; and

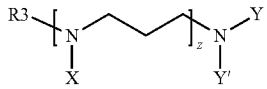

(II)

wherein R3 is a hydrocarbyl group having 8-22, preferably 12-22, and most preferably 16-22 carbon atoms; z is a number 1-3, preferably 1-2, and most preferably 1; X, Y and Y' are, independently, an alkyl group with 1-4 carbon atoms, preferably methyl, or the group $-(EO)_sH$, wherein EO is an ethyleneoxy unit and s is on average 5-50, preferably 7-50, more preferably 9-45, even more preferably 9-40, and most preferably 11-35, and the sum of all s is on average 15 or more, preferably 20 or more, and less than 100, preferably less than 80, more preferably less than 60, even more preferably less than 50, still more preferably less than 40, and most preferably less than 35; provided that at least one of X, Y and Y' is a group $-(EO)_sH$; and where the molar ratio of I to II is from 1:5, preferably from 1:4, more preferably from 1:3, and most preferably from 1:2 to 5:1, preferably to 4:1, more preferably to 3:1, and most preferably to 2:1; are very efficient collectors for removing slime from potash ores.

Thus the invention in one embodiment pertains to such mixtures and in another embodiment pertains to a method for flotating slimes from potash ores by using such a mixture of ethoxylated fatty amines as collector.

Preferred are a method and a mixture wherein R1 and R2, of the compounds according to formula (I) are, independently, a hydrocarbyl group having 8-22 carbon atoms and n has the value stated above, and wherein R3, X, Y, Y', EO, z, s, and the sum of all s of the compounds according to formula (II) are as defined above, are present in a mixture where the molar ratio between I and II is from 1:5 to 5:1.

Another embodiment relates to mixtures, and to the use of such mixtures as collector for flotating slimes from potash ores, of compounds of formula (I), wherein R1 is a hydrocarbyl group having 8-22 carbon atoms, R2 is a hydrocarbyl group having 1-4, preferably 1-2, carbon atoms, or a benzyl group, and n has the value stated above, and compounds of formula (II), as defined above, and where the molar ratio between I and II is 1:5 to 5:1.

Still another embodiment relates to mixtures, and the use of such mixtures as collector for flotating slimes from potash ores, of compounds according to formula (I), wherein R1 and R2 are, independently, a hydrocarbyl group having 8-22 carbon atoms and n has the value stated above, and compounds according to formula (II), wherein X, Y, and Y' are the group $-(EO)_sH$, and wherein R3, EO, z, s, and the sum of all s are as defined above, are present in a mixture and where the molar ratio between I and II is 1:5 to 5:1.

One further embodiment relates to mixtures, and the use of such mixtures as collector for flotating slimes from potash ores, of compounds of formula (I), wherein R1 is a hydrocarbyl group having 8-22 carbon atoms, R2 is a hydrocarbyl group having 1-4, preferably 1-2, carbon atoms, or a benzyl group, and n has the value stated above, and compounds according to formula (II), wherein X, Y, and Y' are the group $-(EO)_sH$, and wherein R3, EO, s, and the sum of all s are as defined above, and where the molar ratio between I and II is 1:5 to 5:1.

By using the new collectors it is possible to achieve better recovery of water insolubles (slime), and the recovery of sylvite preferably is not adversely affected. More preferably, sylvite recovery is increased when a process of the invention is compared with a process wherein just one collector of formula (I) or (II) is used.

The resulting sylvite-containing bottom product will normally be further purified by a second flotation step, wherein the sylvite is floated.

In a further embodiment the present invention also relates to the process where a first treatment in accordance with the invention is followed by a further step which comprises a flotation of sylvite using another collector. This other collector is suitably, but not limited to, a fatty amine.

The present invention is further illustrated by the following examples.

EXAMPLES

General Experimental

Flotation Procedure

Method

In practising the invention, the potash ore is crushed to a desirable flotation size and scrubbed in water that is saturated with dissolved potash ore from the actual ore deposit. The pulp is then charged to a flotation machine and diluted to an appropriate concentration. The machine is started and the required amount of a flocculating polymer is added as a 0.1 to 0.5% water solution; 10 g/t polyacrylamide is used in the examples. The collector diluted in water is then added and the pulp is conditioned for a while. The collector is tested at different dosage levels. The air is turned on and the resulting froth containing the slimes (water insolubles) is skimmed off as tailing.

The cell product (non-flotated), also known as bottom product, contains the concentrated potash ore ready to be processed further.

Samples of the froth fraction or slime product and the cell product are dried and analysed for KCl and water insolubles (W.I.) present in both fractions. The material balance, i.e recovery of W.I. and KCl, is calculated for the evaluation of results. The content of W.I. and KCl in the flotation feed (the ore sample that was flotated) is calculated as the sum of the found content of both the slime product and the cell product for each test. This differs to some extent when compared with the overall analysis, which can be explained as small variations in the ore sample and variations between the analyses. The results of the tests are presented in the following tables.

In the slime product the content and recovery of KCl should be low and the W.I. content and recovery should be high. If this condition is met, it means that the flotation is efficient and selective, and the losses of the valuable mineral KCl are low. The cell product should contain a low grade of W.I. The selectivity index (Recovery KCl/Recovery W.I.) is calculated to illustrate the selectivity, and this value should be low. All percentages presented are percentages by weight.

Example 1

In this example slime is flotated from a potash ore comprising on average 36.3% by weight (% w/w) of KCl and on average 3.5% w/w of water insolubles (W.I.) (see Table 1B) using secondary hydrogenated di(tallow alkyl) amine that has been ethoxylated with 30 moles of EO as slime collector, as compared to flotation using primary hydrogenated mono(tallow alkyl) amine that has been ethoxylated with 30 moles of EO.

Polyacrylic amide is present as flocculant in an amount of 10 g/1,000 kg. The content of KCl and W.I. in the slime product and in the cell product was determined. From these values and the weight recovery, the total content of KCl and W.I. in the ore sample used in the flotation was calculated. Using this data the recovery of KCl and W.I. in the slime product, determining the selectivity index for the slime product, was then calculated for all flotation experiments.

TABLE 1A

| Collector dosage, | Foam product of Slime Flotation | | | | | Cell product | |
|---|---|---|---|---|---|---|---|
| g/1,000 kg | Content, % | | Recovery, % | | $K_{selectivity}$ | Content, % | |
| of ore | KCl | W.I. | KCl | W.I. | $Rec_{KCl}/Rec_{W.I.}$ | KCl | W.I. |
| Tallow alkyl 1,3-propylenediamine EO = 25 | | | | | | | |
| 5 | 29.3 | 23.0 | 6.2 | 55.0 | 0.112 | 36.8 | 1.6 |
| 10 | 27.0 | 23.1 | 6.1 | 58.6 | 0.105 | 36.0 | 1.4 |
| 15 | 26.6 | 24.2 | 6.4 | 63.0 | 0.102 | 36.1 | 1.3 |
| 20 | 20.9 | 23.6 | 5.4 | 64.7 | 0.083 | 35.8 | 1.2 |
| Secondary hydrogenated di (tallow alky) amine EO = 30 | | | | | | | |
| 5 | 29.2 | 24.4 | 5.9 | 54.4 | 0.109 | 36.2 | 1.6 |
| 10 | 27.7 | 25.8 | 5.5 | 57.2 | 0.096 | 36.1 | 1.5 |
| 15 | 28.4 | 28.2 | 5.2 | 59.0 | 0.088 | 36.8 | 1.4 |
| 20 | 27.0 | 28.3 | 5.0 | 60.4 | 0.083 | 35.9 | 1.3 |
| Tallow alkyl 1,3-propylenediamine EO = 25:Secondary hydrogenated di (tallow alkyl) amine EO = 30 (2:1) | | | | | | | |
| 5 | 19.8 | 25.1 | 4.4 | 61.1 | 0.072 | 36.5 | 1.4 |
| 10 | 18.5 | 23.7 | 4.5 | 62.0 | 0.073 | 36.7 | 1.4 |
| 15 | 17.3 | 22.7 | 4.6 | 64.7 | 0.071 | 37.2 | 1.3 |
| 20 | 17.2 | 23.6 | 4.4 | 66.4 | 0.067 | 37.4 | 1.2 |
| Tallow alkyl 1,3-propylenediamine EO = 25:Secondary hydrogenated di (tallow alkyl) amine EO = 30 (1:2) | | | | | | | |
| 5 | 22.6 | 22.4 | 5.4 | 58.9 | 0.092 | 36.3 | 1.4 |
| 10 | 21.8 | 23.4 | 5.1 | 60.2 | 0.085 | 36.6 | 1.4 |
| 15 | 18.9 | 22.4 | 4.9 | 62.4 | 0.079 | 36.5 | 1.4 |
| 20 | 18.4 | 24.1 | 4.4 | 63.3 | 0.070 | 36.5 | 1.3 |

TABLE 1B

| Ore sample, calculated content (%) | |
|---|---|
| KCI | W.I. |
| Tallow alkyl 1,3-propylenediamine EO = 25 | |
| 36.2 | 3.3 |
| 35.3 | 3.1 |
| 35.3 | 3.2 |
| 34.5 | 3.1 |
| Secondary hydrogenated di (tallow alkyl) amine EO = 30 | |
| 35.7 | 3.2 |
| 35.5 | 3.2 |
| 36.2 | 3.2 |
| 35.3 | 3.1 |
| Tallow alkyl 1,3-propylenediamine EO = 25:Secondary hydrogenated di (tallow alkyl) amine EO = 30 (2:1) | |
| 35.2 | 3.3 |
| 35.1 | 3.4 |
| 35.3 | 3.3 |
| 35.6 | 3.2 |
| Tallow alkyl 1,3-propylenediamine EO = 25:Secondary hydrogenated di (tallow alkyl) amine EO = 30 (1:2) | |
| 35.2 | 3.1 |
| 35.4 | 3.2 |
| 34.9 | 3.4 |
| 35.0 | 3.2 |

When using the same dosage, the selectivity index was lower for the flotation experiments performed with mixtures of the tallow alkyl 1,3-propylene diamine (25 EO) and the ethoxylated secondary hydrogenated di(tallow alkyl) amine (30 EO) according to the invention than for the comparison experiments performed with the single components. This means that the product mixture according to the invention is more efficient than the comparison compounds in flotating the slime product away from the potash ore without giving rise to large losses of KCl.

The invention claimed is:

1. A flotation method for removing slimes from potash ores which comprises adding a collector to said ores, wherein said collector comprises a mixture of ethoxylated fatty amines having the formulae (I)

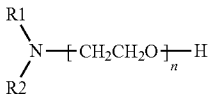

wherein R1 and R2 are, independently, a hydrocarbyl group having 1-22 C-atoms, and n is on average above 15 and less than 100; and (II)

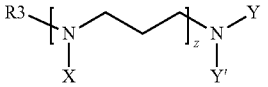

wherein R3 is a hydrocarbyl group having 8-22 carbon atoms; z is a number 1-3; X, Y and Y' are, independently, an alkyl group with 1-4 carbon atoms, or the group $-(EO)_sH$, wherein EO is an ethyleneoxy unit and s is on average 5-50, and the sum of all s is on average 15 or more and less than 100; provided that at least one of X, Y and Y' is a group $-(EO)_sH$; and where the molar ratio of I to II is 1:5 to 5:1.

2. A method according to claim 1 wherein the collector contains compounds according to formula (I), wherein R1 and R2 are, independently, a hydrocarbyl group having 8-22 carbon atoms and n has the value stated above, and compounds according to formula (II), wherein R3, X, Y, Y', EO, z, s, and the sum of all s are as defined in claim 1.

3. A method according to claim 1 wherein the collector contains compounds according to formula (I), wherein R1 is a hydrocarbyl group having 8-22 carbon atoms, R2 is a hydrocarbyl group having 1-4, carbon atoms, or a benzyl group, and n and the sum of all n are as defined in claim 1, and compounds according to formula (II), wherein R3, X, Y, Y', EO, z, s, and the sum of all s are as defined in claim 1.

4. A method according to claim 1 wherein the collector contains compounds according to formula (I), wherein R1 and R2 are, independently, a hydrocarbyl group having 8-22 carbon atoms and n has the value stated above, and compounds according to formula (II), wherein X, Y, and Y' are the group $-(EO)_sH$, and wherein R3, EO, z, s, and the sum of all s are as defined in claim 1.

5. A method according to claim 1 wherein the collector contains compounds according to formula (I), wherein R1 is a hydrocarbyl group having 8-22 carbon atoms, R2 is a hydrocarbyl group having 1-4, carbon atoms, or a benzyl group, and n and the sum of all n are as defined in claim 1, and compounds according to formula (II), wherein X, Y, and Y' are the group $-(EO)_sH$, and wherein R3, EO, z, s, and the sum of all s are as defined in claim 1.

6. A method according to claim 1 wherein said potash ores comprise sylvite, wherein the removal of slime is followed by a further step which comprises a flotation of sylvite using a second collector.

7. A method according to claim 6 wherein said second collector in the further step is a fatty amine.

8. A mixture of compounds having the formulae (I)

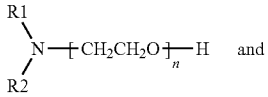

and (II)

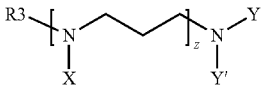

wherein R1 and R2 are, independently, a hydrocarbyl group having 1-22 C-atoms, and n is on average above 15; R3 is a hydrocarbyl group having 8-22 carbon atoms; z is a number 1-3; X, Y and Y' are, independently, an alkyl group with 1-4 carbon atoms, or the group $-(EO)_sH$, wherein EO is an ethyleneoxy unit and s is on average 5-50, and the sum of all s is on average 15 or more and less than 100; provided that at least one of X, Y and Y' is a group $-(EO)_sH$; and where the molar ratio of I to II is 1:5 to 5:1.

9. The flotation method of claim 1 wherein n is on average above 20 and less than 80; R3 is a hydrocarbyl group having 12-22 carbon atoms; z is a number 1-2; X, Y and Y' are, independently, an alkyl group with 1-4 carbon atoms, or the group $-(EO)_sH$, wherein EO is an ethyleneoxy unit and s is on average 7-50, and the sum of all s is on average 20 or more and less than 80; provided that at least one of X, Y and Y' is a group $-(EO)_sH$; and where the molar ratio of I to II is 1:5 to 5:1.

10. The flotation method of claim 1 wherein n is on average above 20 and less than 60; R3 is a hydrocarbyl group having 16-22 carbon atoms; z is 1; X, Y and Y' are, independently, an alkyl group with 1-4 carbon atoms, or the group $-(EO)_sH$, wherein EO is an ethyleneoxy unit and s is on average 9-45, and the sum of all s is on average 20 or more and less than 60; provided that at least one of X, Y and Y' is a group $-(EO)_sH$; and where the molar ratio of I to II is 1:5 to 5:1.

11. The flotation method of claim 1 wherein n is on average above 20 and less than 50; R3 is a hydrocarbyl group having 16-22 carbon atoms; z is 1; X, Y and Y' are, independently, methyl, or the group $-(EO)_sH$, wherein EO is an ethyleneoxy unit and s is on average 11-35, and the sum of all s is on average 20 or more and less than 40; provided that at least one of X, Y and Y' is a group $-(EO)_sH$; and where the molar ratio of I to II is 1:5 to 5:1.

12. The mixture of claim 8 wherein n is on average above 20 and less than 50; R3 is a hydrocarbyl group having 16-22 carbon atoms; z is 1; X, Y and Y' are, independently, methyl, or the group $-(EO)_sH$ wherein EO is an ethyleneoxy unit and s is on average 11-35, and the sum of all s is on average 20 or more and less than 40; provided that at least one of X, Y and Y' is a group $-(EO)_sH$; and where the molar ratio of I to II is 1:5 to 5:1.

* * * * *